US009747767B2

(12) United States Patent
Hu et al.

(10) Patent No.: US 9,747,767 B2
(45) Date of Patent: Aug. 29, 2017

(54) ACOUSTIC MAGNETIC TAG

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Jian-Wei Hu, Shenzhen (CN); Tao Sun, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/056,123

(22) Filed: Feb. 29, 2016

(65) Prior Publication Data

US 2017/0186295 A1 Jun. 29, 2017

(30) Foreign Application Priority Data

Dec. 24, 2015 (CN) ..... 2015 1 0978783

(51) Int. Cl.
*G08B 13/24* (2006.01)

(52) U.S. Cl.
CPC ..... *G08B 13/2422* (2013.01); *G08B 13/2434* (2013.01); *G08B 13/2408* (2013.01); *G08B 13/2437* (2013.01)

(58) Field of Classification Search
CPC ..... G08B 13/2434; G08B 13/2422
See application file for complete search history.

(56) References Cited

U.S. PATENT DOCUMENTS

| | | | | |
|---|---|---|---|---|
| 4,510,490 | A * | 4/1985 | Anderson, III | G01V 15/00 148/304 |
| 4,622,543 | A * | 11/1986 | Anderson, III | G01V 15/00 340/572.1 |
| 6,067,016 | A * | 5/2000 | Deschenes | B29C 47/0019 340/572.6 |
| 7,005,989 | B2 * | 2/2006 | Benoit | G08B 13/2434 340/568.1 |
| 7,775,364 | B1 * | 8/2010 | Archambault | B65D 25/02 206/521.1 |
| 2010/0213263 | A1 * | 8/2010 | Ho | B65D 85/30 235/487 |
| 2013/0036780 | A1 * | 2/2013 | Valade, Jr. | G08B 13/2434 70/275 |

* cited by examiner

*Primary Examiner* — Curtis King
*Assistant Examiner* — Rajsheed Black-Childress
(74) *Attorney, Agent, or Firm* — Steven Reiss

(57) ABSTRACT

An acoustic magnetic tag includes a housing, a resonant sheet, and a biasing magnetic sheet received in the main body. The housing includes a main body having an opening, a first connecting portion connected to one side of the main body, a second connecting portion connected to an other side of the main body opposite to the one side, a partition connected to the first connecting portion, and a cover connected to the second connecting portion. The partition is rotated relative to the main body to be received in the main body by folding the first connecting portion, and the cover is rotated relative to the main body to cover the opening by folding the second connecting portion. The partition is positioned between the resonant sheet and the biasing magnetic sheet.

13 Claims, 7 Drawing Sheets

ACOUSTIC MAGNETIC TAG

FIELD

The subject matter herein generally relates to a security tag, and particularly, to an acoustic magnetic tag.

BACKGROUND

Security tags are widely used to be affixed to merchandises to protect the merchandises from unauthorized removal. An acoustic magnetic tag, as one type of the typical security tag, can include a housing having an opening, a resonant sheet, a biasing magnetic sheet, a separator plate, and a sealing film. In operation, the resonant sheet, the separator plate, and the biasing magnetic sheet are assembled into the housing in sequence, and then the opening of the housing is sealed by the sealing film.

BRIEF DESCRIPTION OF THE DRAWINGS

Implementations of the present technology will now be described, by way of example only, with reference to the attached figures.

DETAILED DESCRIPTION

Figure 1:
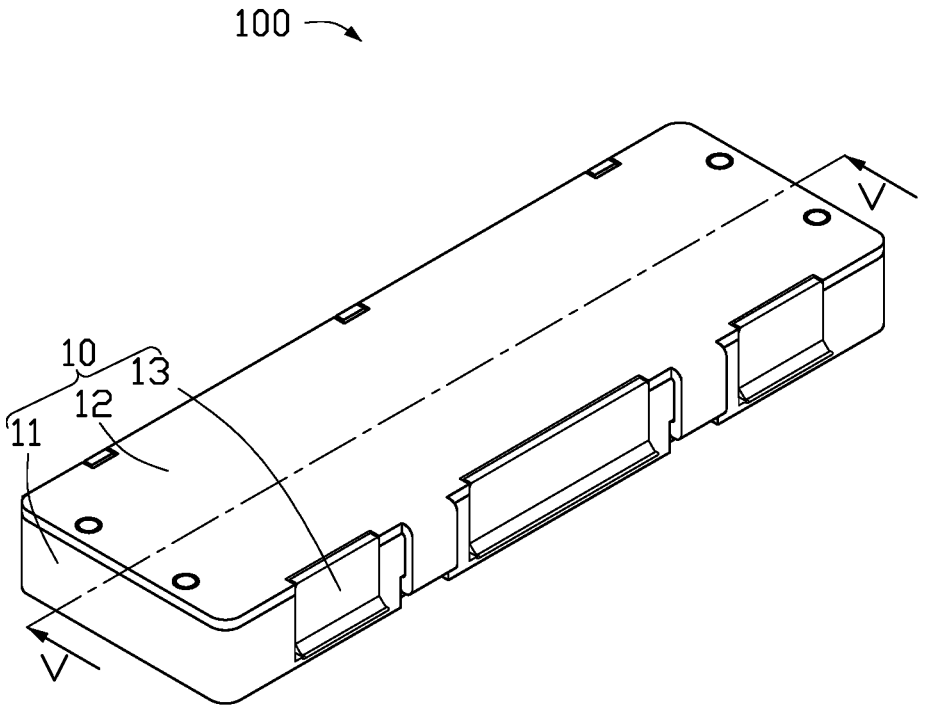
FIG. 1 is an isometric view of a first embodiment of an acoustic magnetic tag.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as coupled, whether directly or indirectly through intervening components, and is not necessarily limited to physical connections. The connection can be such that the objects are permanently coupled or releasably coupled. The term "comprising" when utilized, means "including, but not necessarily limited to"; it specifically indicates open-ended inclusion or membership in the so-described combination, group, series and the like.

The present disclosure is described in relation to a housing, an electronic device including the housing, and a method of manufacturing the housing.

FIG. 1 illustrates that an acoustic magnetic tag 100 of a first embodiment can include a housing 10. In at least one embodiment, the housing 10 can be substantially rectangular. The housing 10 can include a main body 11, a cover 12, and a partition 13.

Figure 2:
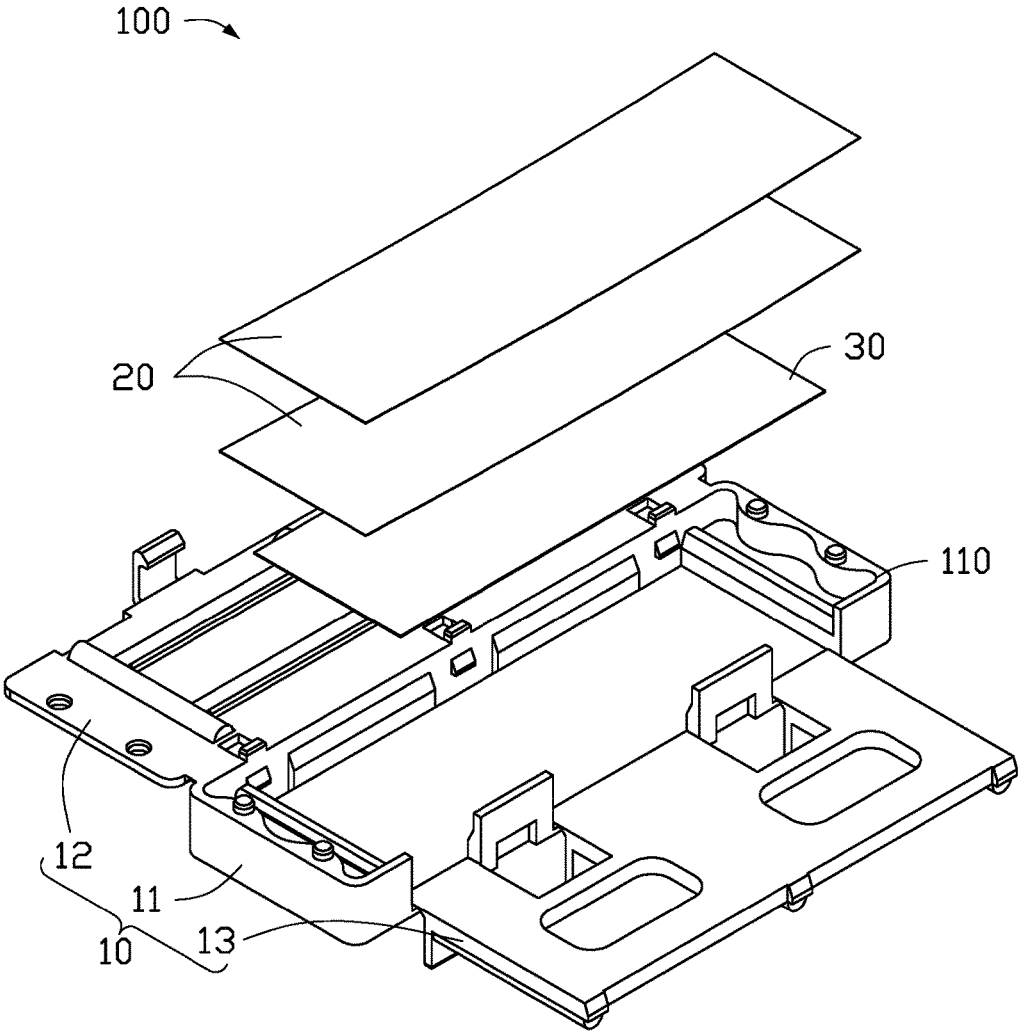
FIG. 2 is an exploded view of the acoustic magnetic tag shown in FIG. 1.

FIG. 2 illustrates that the acoustic magnetic tag 100 can further include two resonant sheets 20 and a biasing magnetic sheet 30 received in the housing 10. The resonant sheets 20 and the biasing magnetic sheet 30 can be rectangular sheets. The main body 11 can be substantially box-shaped and include an opening 110. The resonant sheets 20 and the biasing magnetic sheet 30 can be placed into the main body 11 through the opening 110. In other embodiments, the acoustic magnetic tag 100 can include one or more resonant sheets 20.

Figure 3:
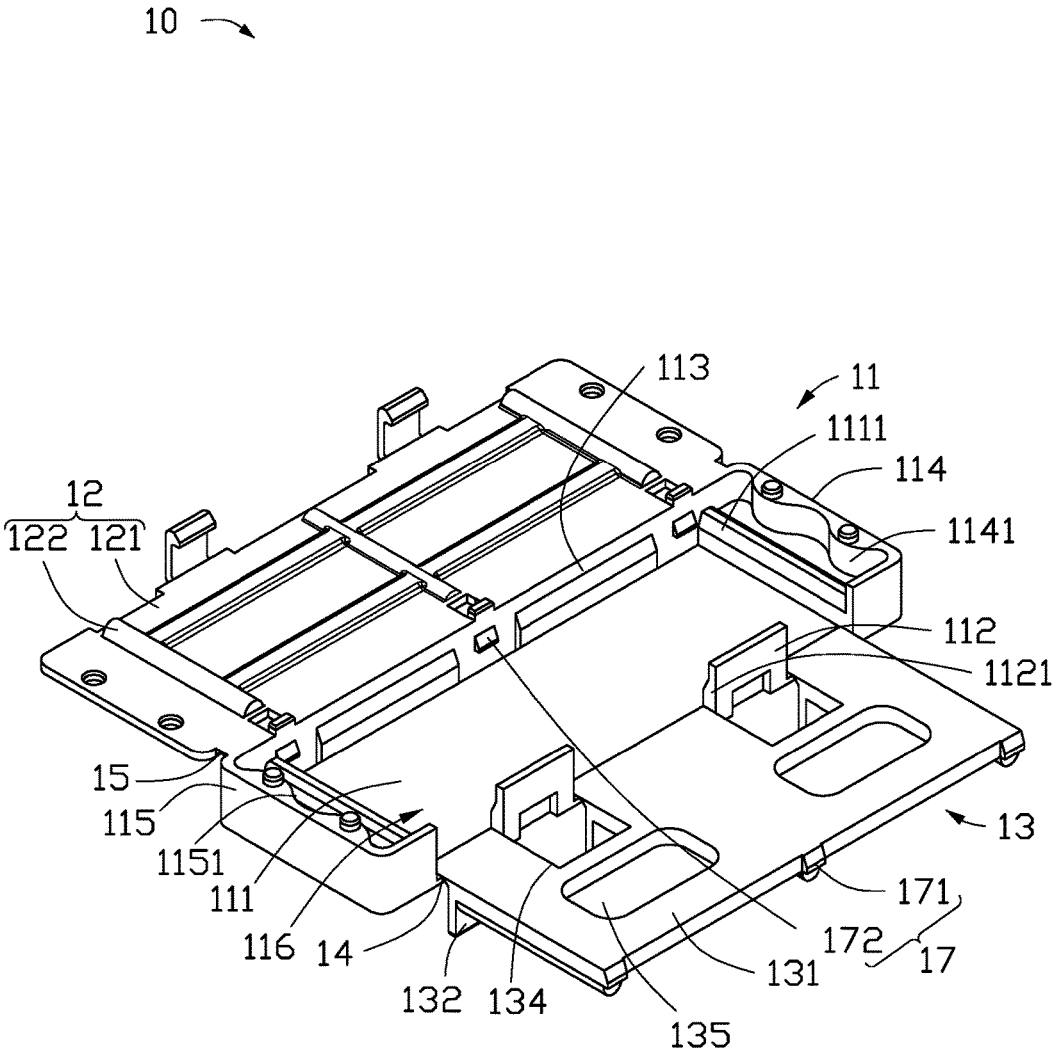
FIG. 3 is an isometric view of a housing of the acoustic magnetic tag shown in FIG. 1.

FIG. 3 illustrates that the main body 11 can include a bottom plate 111, a first sidewall 112, a second sidewall 113, a third sidewall 114, and a fourth sidewall 115. The bottom plate 111 can be rectangular and opposite to the opening 110 (shown in FIG. 2). The first sidewall 112, the second sidewall 113, the third sidewall 114, and the fourth sidewall 115 can be perpendicular to the bottom plate 111 and cooperatively form a receiving chamber 116 with the bottom plate 111. In at least one embodiment, the first sidewall 112 faces the second sidewall 113, and the third sidewall 114 is parallel with the fourth sidewall 115. The bottom plate 111 can include two limit portions 1111 located in the receiving chamber 116. The limit portions 1111 can be substantially strip shaped and respectively positioned near the third sidewall 114 and the fourth sidewall 115. The limit portions 1111 can be configured to abut two sides of the biasing magnetic sheet 30 (shown in FIG. 5).

The housing 10 can further include a first connecting portion 14 positioned between the partition 13 and the main body 11, and a second connecting portion 15 positioned between the cover 12 and the main body 11. The first connecting portion 14 and the second connecting portion 15 can be positioned at two sides of the main body 11. The first connecting portion 14 can be bent, thereby the partition 13 can rotate to be received in the main body 11 through the opening 110, and the partition 13 can be configured to separate the resonant sheets 20 and the biasing magnetic sheet 30. The second connecting portion 15 can be bent, thereby the cover 12 can rotate to cover the opening 110. The first connecting portion 14 and the second connecting portion 15 can be made of a flexible material. In at least one embodiment, the partition 13 is rotated relative to the main body 11 to be received in the main body 11 by folding the first connecting portion 14, and the cover 12 is rotated relative to the main body 11 to cover the opening 110 by folding the second connecting portion 15. In other embodiments, the first connecting portion 14 and the second connecting portion 15 can be replaced by pivots, as long as the cover 12 and the partition 13 can rotate relative to the main body 11.

The first sidewall 112 can define a plurality of gaps 1121 which can expose a portion of the bottom plate 111. The first connecting portion 14 can be coupled to bottom plate 111 corresponding to the gaps 1121, and the partition 13 can be coupled to the first sidewall 112. One side of the second sidewall 113 away from the bottom plate 111 can be coupled to the second connecting portion 15, and the cover 12 can be coupled to the second sidewall 113. The third sidewall 114 and the fourth sidewall 115 can be perpendicularly connected to the first sidewall 111 and the second sidewall 113. The third sidewall 114 can include at least one first abutting portion 1141, and the fourth sidewall 115 can include at least one second abutting portion 1151. The first abutting portion 1141 and the second abutting portion 1151 can be configured to abut two sides of each resonant sheets 20.

In at least one embodiment, there are three gaps 1121. The first abutting portions 1141 can be two, and the second abutting portions 1151 can be two. The two abutting portions 1141 can be connected to form a wavy shaped embossment. In other embodiments, the number of the gap 1121 can be one, two, or more.

The cover 12 can include a cover plate 121 and a plurality of pressing members 122 protruding out of the cover plate 121. The cover plate 121 can be rectangular and configured to cover the opening 110 to seal the main body 11. One side of the cover plate 121 can be coupled to the second connecting portion 15. The pressing members 122 can be strip shaped and formed on a surface of the cover plate 121 toward the bottom plate 111. The pressing members 122 can be configured to press the two resonant sheets 20. In at least one embodiment, the pressing members 122 can be three, and the three pressing members 122 can be parallel and spaced from each other. The pressing members 122 can be parallel to third sidewall 114 and the fourth sidewall 155.

The partition 13 can include a separator plate 131, a plurality of compensation plates 132 corresponding to the gaps 1121, and a plurality of supporting members 133. One side of the separator plate 131 can be coupled to the first connecting portion 14, and each compensation plate 132 can be perpendicularly connected to a surface of the separator plate 131 away from the base plate cover 12, and a shape of the compensation plates 132 can be same with a shape of the corresponding gaps 1121. The compensation plate 132 is matched with the gap 1121, so the gap 1121 can be sealed by the compensation plate 132. The supporting members 133 can be parallel and spaced from each other, and the supporting members 133 can be positioned at a surface of the separator plate 131 away from the bottom plate 111. The supporting members 133 can be strip-shaped and configured to support the two resonant sheets 20. In at least one embodiment, the supporting members 133 can be three, and the three supporting members 133 can be positioned corresponding to the three pressing members 122, thereby the two resonant sheets 20 can be received between the separator plate 131 and the cover plate 121.

The separator plate 13 can define two through holes 134 and two inspection windows 135. The two through holes 134 can be defined corresponding to the first sidewall 112 and defined at two sides of the middle gap 1121. When the separator plate 131 rotates relative to the bottom plate 111, a part of the first sidewall 112 between each two neighboring gaps 1121 can get through the corresponding through holes 134, thereby first sidewall 112 would not block the movement of the separator plate 131. The two inspection windows 135 can be defined through the separator plate 131, thereby users can view the biasing magnetic sheet 30 through the inspection windows 135. Each inspection window 135 can be substantially rectangular and defined between two supporting members 133. A number of the inspection window 135 can be one or more, and the inspection window 135 can be other shapes, such as a circular shape.

The main body 11 can further include at least one latch assembly 17. In at least one embodiment, the housing can include three latch assemblies 17 spaced from each other. Each latch assembly 17 can include a latching block 171 and a protrusion 172 configured to couple with the latching block 171. The latching block 171 can be formed on one side of the separator plate 131 away from the first connecting portion 14. The protrusion 172 can be formed on a surface of the second sidewall 113 toward the first sidewall 112. In at least one embodiment, a cross-section of the protrusion 172 can be a right triangle. When the separator plate 131 is received in the main body 11, the latching blocks 171 is snapped together with the corresponding protrusions 172, thereby the separator plate 131 can be fixed in the main body 11.

Figure 4:
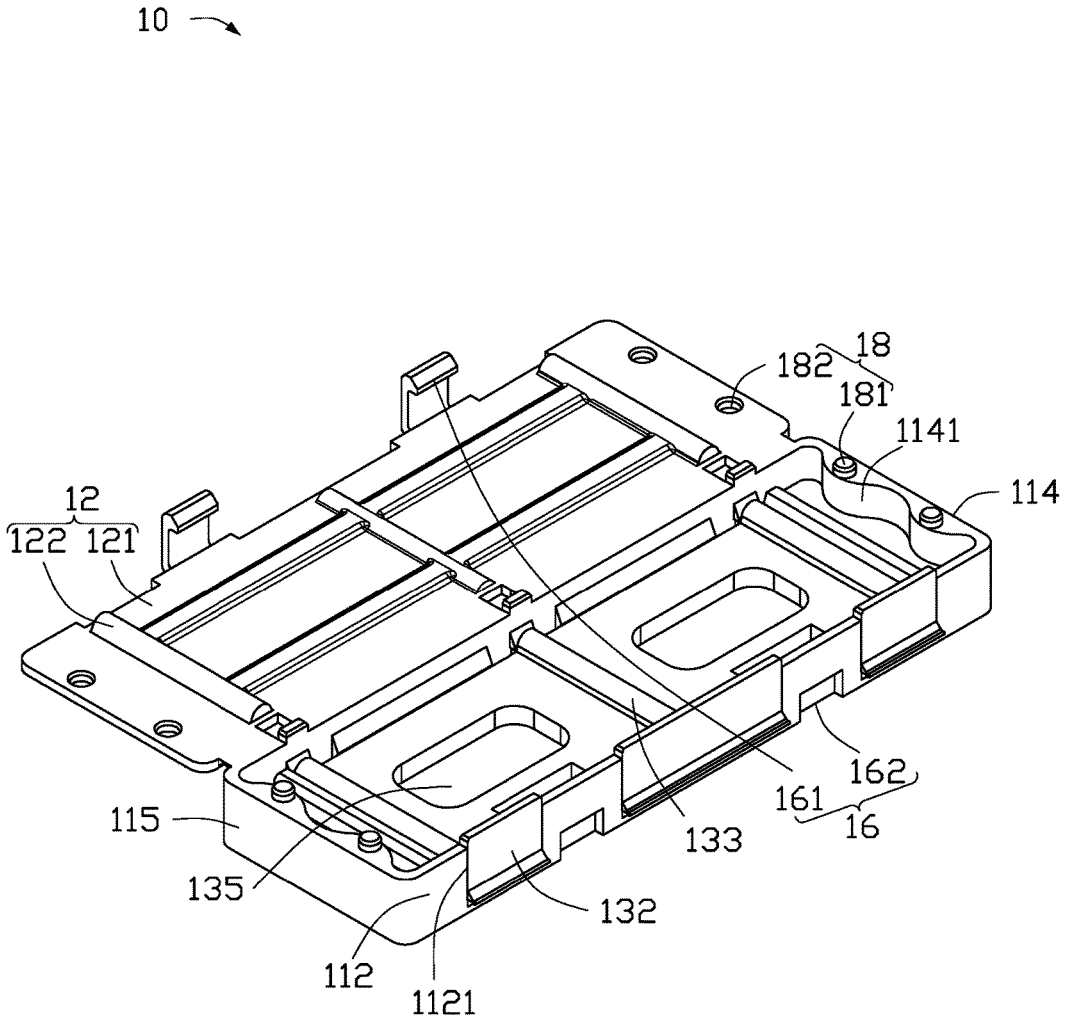
FIG. 4 is an isometric view showing a separator plate being received in a main body of the housing shown in FIG. 3

FIG. 4 illustrates that the separator plate 131 is positioned in the main body 11. At this time, the compensation plates 132 can be placed in the corresponding gaps 141 (shown in FIG. 3) to seal the gaps 141. The main body 11 can further include at least one lock assembly 16 including a latch hook 161 and a latch groove 162. The latch hook 161 can be formed at one side of the cover plate 121 away from the second connecting portion 15. The latch groove 162 can be defined in a surface of the first sidewall 112 away from the second sidewall 113. When the cover plate 121 covers the opening 110 of the main body 11, the latch hook 161 can be snapped into the latch groove 162, thereby the cover plate 121 can be fixedly positioned on the main body 11. In at least one embodiment, the main body 11 can include two locking assemblies 16.

The main body 11 can further include at least one locating assembly 18 including a locating bulge 181 and a locating hole 182. A shape of the locating hole 182 can match to a shaped of the locating bulge 181. In at least one embodiment, the main body 11 can include four locating assemblies 18. Two locating bulges 181 can protrude out of the third sidewall 114, and the other two locating bulges 181 can protrude out of the fourth sidewall 115. The four locating holes 182 can be defined at two ends of the cover plate 121 adjacent to the third sidewall 114 and the fourth sidewall 115. The locating bulges 181 can be received in the corresponding locating holes 182 when the cover plate 11 covers the opening 110 (shown in FIG. 2).

Figure 5:
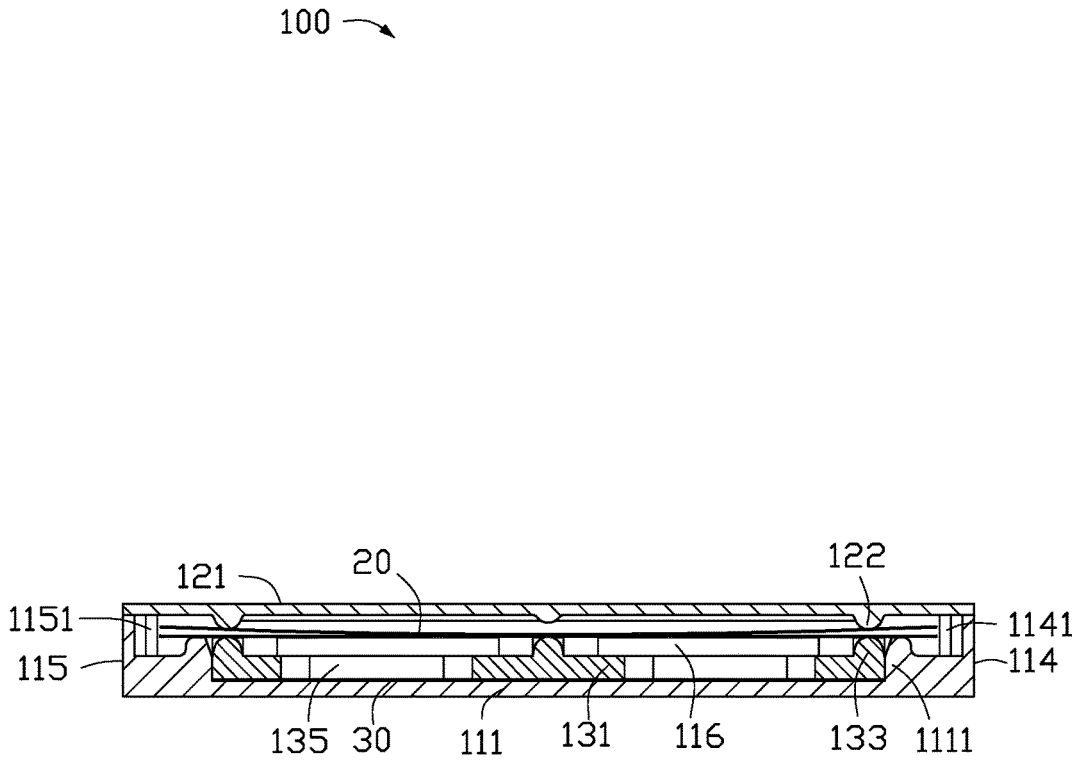
FIG. 5 is a cross-sectional view of the acoustic magnetic tag taken along a line V-V of FIG. 1.

FIG. 5 illustrates that the separator plate 131 can be positioned between the resonant sheets 20 and the biasing magnetic sheet 30, and the two resonant sheets 20 can be positioned between the pressing members 122 and the supporting members 133.

In operation, the biasing magnetic sheet 30 can be positioned on the bottom plate 111, and the separator plate 131 can rotate relative to the main body 11 and cover the biasing magnetic sheet 30. The latching blocks 171 can be latched with the corresponding protrusions 172 to fix the separator plate 131 in the main body 11. Then, the two resonant sheets 20 can be stacked on the three supporting members 133. The cover plate 121 can rotate to cover the opening 110, and the locating bulges 181 can be inserted into the corresponding locating holes 182 to align the cover plate 121 to the opening 110. At the same time, the two latch hooks 161 can be coupled to the corresponding latch grooves 162 to fix the cover 12 to the main body 11.

The housing 10 of the acoustic magnetic tag 100 can be molded in one body, so the housing 10 has convenience in use and simplified manufacture process. The cover 12 and the partition 13 can be rotatably connected to the housing 10, the cover 12 can be fixed to the main body 11 by the lock assembly 16, and the partition 13 can be fixed to the housing by the latch assembly 17. Therefore, the acoustic magnetic tag 100 has a simplified assembly process.

Figure 6:
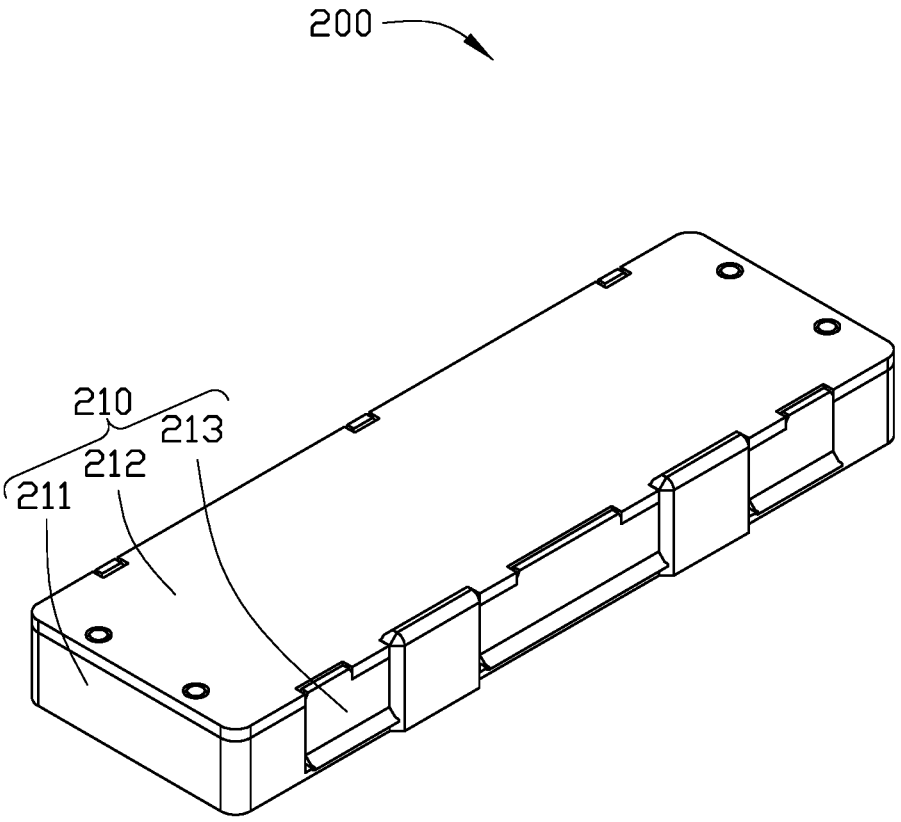
FIG. 6 is an isometric view of a second embodiment of an acoustic magnetic tag.

FIG. 6 illustrates an acoustic magnetic tag 200 of a second embodiment of this disclosure. The acoustic magnetic tag 200 can include a housing 210. The housing 210 can include a main body 211, a cover 212, and a partition 213.

Figure 7:
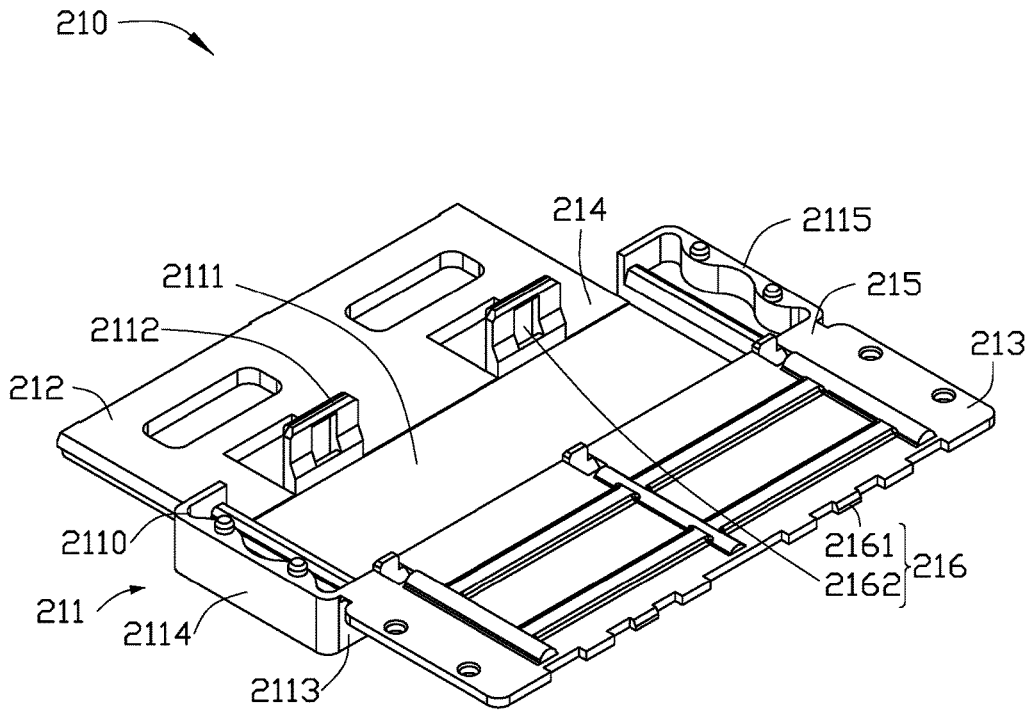
FIG. 7 is an isometric view showing a partition and a cover being taken out of a main body of the acoustic magnetic tag shown in FIG. 6.

FIG. 7 illustrates that the housing 210 can include a main body 211, a cover 212, a partition 213, a first connecting portion 214, a second connecting portion 215, and two locking assemblies 216. One end of the main body 211 can define an opening 2110, the first connecting portion 214 can connect the partition 213 and the main body 211, and the second connecting portion 215 can connect the cover 212 and the main body 211. The first connecting portion 214 and the second connecting portion 215 can be bent, thereby the partition 13 can be received in the main body 211, and the cover 212 can cover the opening 2110. The main body 211 can include a bottom plate 2111, a first sidewall 2112, a second sidewall 2113, a third sidewall 2114, and a fourth sidewall 2115. The acoustic magnetic tag 200 can be similar to the acoustic magnetic tag 100, except that, the lock assembly 216 includes a lock catch 2161 and a lock groove 2162. The lock catch 2161 can be positioned at one side of the cover 212 away from the second connecting portion 215, and the lock groove 2162 can be defined on a surface of the first sidewall 2112 toward the second sidewall 2113. The lock catch 2161 can be snapped into the corresponding latch groove 2162 to fix the cover 212 to the main body 211.

The lock catch 2161 of the acoustic magnetic tag 200 can replace the latch hook 161. It is simpler to form the lock catch 2161 in a mold than the latch hook 161. Thereby, the complexity of manufacturing can be decreased and the manufacturing cost can be reduced.

The embodiments shown and described above are only examples. Many details are often found in the art such as the other features of an acoustic magnetic tag. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including, the full extent established by the broad general meaning of the terms used in the claims. It will therefore be appreciated that the embodiments described above may be modified within the scope of the claims.

What is claimed is:

1. An acoustic magnetic tag comprising:

a housing comprising:

a main body defining an opening, a first connecting portion connected to one side of the main body, a second connecting portion connected to an other side of the main body opposite to the one side, a partition connected to the first connecting portion, and a cover connected to the second connecting portion;

a resonant sheet, received in the main body, and a biasing magnetic sheet received in the main body;

wherein the partition is rotated relative to the main body and configured to be received in the main body by folding the first connecting portion, and the cover is rotated relative to the main body to cover the opening by folding the second connecting portion; and wherein the partition is sandwiched between the resonant sheet and the biasing magnetic sheet;

wherein the main body comprises a bottom plate and a first sidewall, the bottom plate is positioned opposite to the opening, the first sidewall defines at least one gap to expose a portion of the bottom plate, the partition comprises a separator plate and at least one compensation plate, one end of the separator plate is connected to the first connecting portion, and the at least one compensation plate is perpendicularly connected to a surface of the separator plate away from the bottom plate, the at least one compensation plate is matched with the at least one gap, and the at least one gap is sealed by the at least one compensation plate.

2. The acoustic magnetic tag as claimed in claim 1, wherein the main body further comprises a second sidewall, a third sidewall, and a fourth sidewall, the first sidewall faces the second sidewall, and the third sidewall is parallel to the fourth sidewall; and wherein the bottom plate, the first sidewall, the second sidewall, the third sidewall, and the fourth sidewall cooperatively form a receiving chamber configured to receive the resonant sheet and the biasing magnetic sheet.

3. The acoustic magnetic tag as claimed in claim 2, wherein the acoustic magnetic tag further comprises at least one lock assembly, and the at least one lock assembly comprises a latch hook and a latch groove; and wherein the latch hook is positioned at one side of the cover away from the second connecting portion, the latch groove is defined at a surface of the first sidewall away from the second sidewall, and the latch hook is snapped into the latch groove to fix the cover to the main body.

4. The acoustic magnetic tag as claimed in claim 2, wherein the acoustic magnetic tag further comprises at least one lock assembly, and the at least one lock assembly comprises a lock catch and a lock groove; and wherein the lock catch is positioned at one side of the cover away from the second connecting portion, the lock groove is defined at a surface of the first sidewall toward the second sidewall, and the lock catch is snapped into the lock groove to fix the cover to the main body.

5. The acoustic magnetic tag as claimed in claim 2, wherein the acoustic magnetic tag further comprises at least one latch assembly, and the at least one lock assembly comprises a latching block and a protrusion corresponding to the latching block;

wherein the lock catch is positioned at one side of the partition away from the first connecting portion, the protrusion is positioned at the second sidewall, and the lock catch is snapped together with the protrusion to fix the partition to the main body.

6. The acoustic magnetic tag as claimed in claim 2, wherein the main body further comprises at least one locating bulge, and the cover comprises at least one locating hole corresponding to the at least one locating bulge.

7. The acoustic magnetic tag as claimed in claim 2, wherein the first connecting portion is connected to the portion of the bottom plate corresponding to the at least one gap, and the second connecting portion is connected to the second sidewall.

8. The acoustic magnetic tag as claimed in claim 7, wherein the third sidewall and the fourth sidewall comprise a plurality of abutting portions, and the plurality of abutting portions abuts two sides of the resonant sheet.

9. The acoustic magnetic tag as claimed in claim 7, wherein the bottom plate comprises two limit portions, the two limit portions are located in the receiving chamber and abut two sides of the biasing magnetic sheet.

10. The acoustic magnetic tag as claimed in claim 7, wherein the cover comprises a cover plate and a plurality of pressing members, and one side of the cover plate is connected to the second connecting portion; and wherein the plurality of pressing members is positioned at one side of the cover plate toward the bottom plate, and the resonant sheet is pressed by the pressing members.

11. The acoustic magnetic tag as claimed in claim 7, wherein the separator plate defines at least one through hole corresponding to a portion of the first sidewall other than the at least one gap.

12. The acoustic magnetic tag as claimed in claim 7, wherein the separator plate defines at least one inspection window, and the at least one inspection window gets through the separator plate.

13. The acoustic magnetic tag as claimed in claim 7, wherein the partition further comprises at least one supporting member positioned on a surface of the separator plate away from the bottom plate, and the resonant sheet is supported by the at least one supporting member.

* * * * *